US007066739B2

(12) United States Patent
McLeish

(10) Patent No.: US 7,066,739 B2
(45) Date of Patent: Jun. 27, 2006

(54) CONNECTOR

(76) Inventor: Graham John McLeish, Woolmill Croft, Ardlethen, Ellon, Aberdeenshire (GB) AB41 8JE ( * ) Notice: Subject to any disclaimer, the term of this patent is extended or adjusted under 35 U.S.C. 154(b) by 0 days.

(21) Appl. No.: 10/520,995

(22) PCT Filed: Jul. 16, 2003

(86) PCT No.: PCT/GB03/03080

§ 371 (c)(1),
(2), (4) Date: Jan. 11, 2005

(87) PCT Pub. No.: WO2004/008581

PCT Pub. Date: Jan. 22, 2004

(65) Prior Publication Data

US 2005/0255718 A1 Nov. 17, 2005

(30) Foreign Application Priority Data

Jul. 16, 2002 (GB) ..... 0216448.1

(51) Int. Cl.
*H01R 11/30* (2006.01)

(52) U.S. Cl. ..... 439/39; 439/924.1

(58) Field of Classification Search ..... 439/38–40, 439/924.1, 924.2

See application file for complete search history.

(56) References Cited

U.S. PATENT DOCUMENTS

| | | | | |
|---|---|---|---|---|
| 3,808,577 | A * | 4/1974 | Mathauser | 439/39 |
| 3,810,258 | A * | 5/1974 | Mathauser | 439/39 |
| 4,767,337 | A * | 8/1988 | Kawasaki et al. | 439/34 |
| 5,401,175 | A * | 3/1995 | Guimond et al. | 439/38 |
| 5,971,810 | A * | 10/1999 | Taylor | 439/675 |
| 6,884,083 | B1 * | 4/2005 | Shepherd | 439/18 |
| 2004/0133065 | A1 * | 7/2004 | Easter et al. | 600/25 |
| 2006/0051981 | A1 * | 3/2006 | Neidlein et al. | 439/39 |
| 2006/0073722 | * | 4/2006 | Allan | 439/246 |

FOREIGN PATENT DOCUMENTS

GB 2360637 A 9/2001

OTHER PUBLICATIONS

Pages 1-7 of applicant's response to Foreign examination report GB0502514.3 dated Aug. 10, 2005 that is associated with Parent PCT application.*

* cited by examiner

*Primary Examiner*—James R. Harvey

(57) ABSTRACT

An electrical connector (100) comprising a male (120) and female (150) part, each part (120, 150) having a magnet (135, 165) adapted to attract the parts (120, 150) together to make a connection. The parts (120, 150) can connect at any relative rotational orientation and preferred embodiments prevent offset connection between the magnets (135, 165) or parts (120, 150). The connector (100) is particularly suited for use in out of reach locations, for example to easily and safely replace light bulbs into sockets suspended from a ceiling.

23 Claims, 17 Drawing Sheets

150
160
165
162
153
161
166

163
168
166
161
162
165
153

103
104
150
152
151

100
160
150
163

139
130
124
126
123
128
127
129
120
101
135
139
123 121 122
140
120
120
123
130
122
136
121

253
252
266
C
C
200
260
251
203
200
200
250

268
268
223
239
220
226
226
200
205
223
222
Sectional view
on C / C
C
C
221

350
365

330
335

338

320
323
322
330

Sectional views on CC

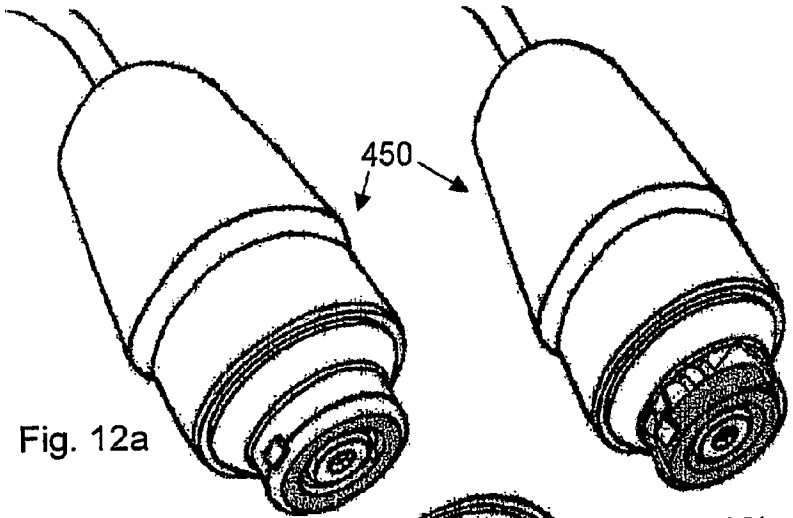
Fig. 12a
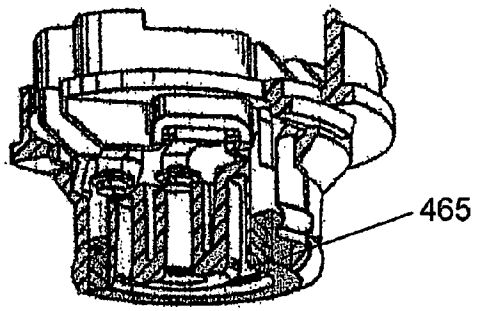
Fig. 12c
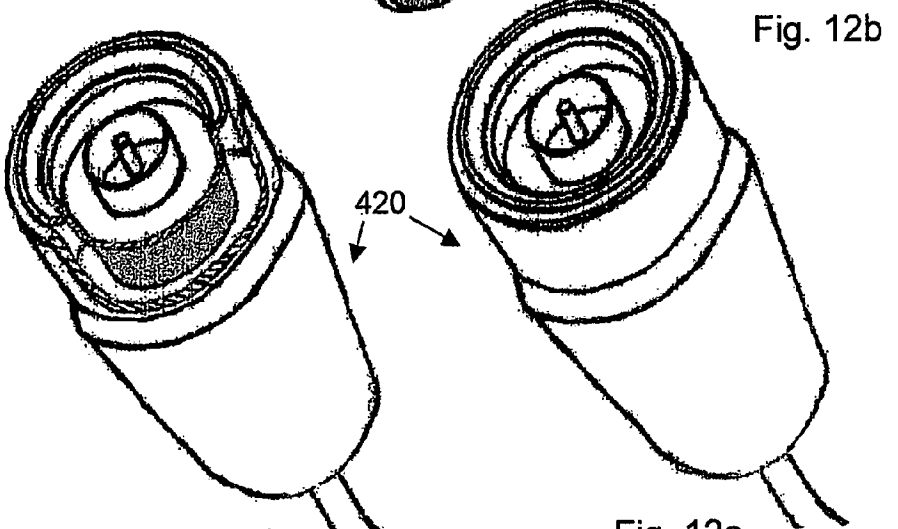
Fig. 12d
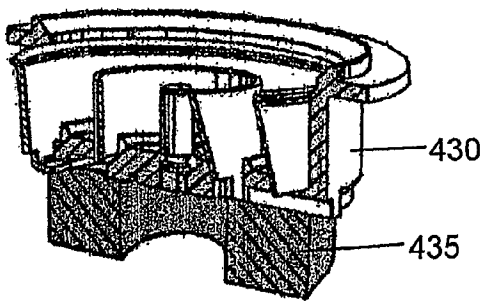
Fig. 12f
Fig. 12b
Fig. 12e

CONNECTOR

TECHNICAL FIELD

This invention relates to an electrical connector, particularly but not exclusively for use in difficult to and/or out of reach locations.

BACKGROUND

Electrical connectors are used in a variety of domestic and industrial Applications. A number of different connectors are known and these vary from application to application, a 3-pin plug and wall socket is a typical example.

There are two popular types of connector for connecting light bulbs to a socket; a thread connection and a bayonet connection. For the thread connection, the bulb thread is rotationally aligned with a thread of the socket and then screwed into the socket allowing respective electric terminals on the bulb and socket to connect.

The bayonet connection has pins which extend radially from the bulb. The pins are aligned with apertures in a circumferentially extending rim of the socket and inserted therethrough against action of a spring in the socket and so to allow respective terminals on the bulb and socket to electrically connect. The bulb is then turned so that the pins move into small recesses in the rim and are no longer aligned with the apertures. The action of the spring engages the pins with an edge of the recesses to hold the bulb in the socket and maintain the electrical connection.

Although these connectors are generally competent, they can be difficult to secure and release, particularly in out of reach places such as sockets suspended from the ceiling.

Moreover, some current light sockets are hazardous because they contain exposed live electrical contacts and are replaced in such out of reach environments when it is often dark because the light is inoperable at that moment. Inadvertent contact with exposed electrical contacts can have potentially fatal consequences.

A connector for a cordless kettle is described in U.S. Pat. No. 5,971,810 the disclosure of which is incorporated herein by reference. This connector, shown in FIGS. 1*a*–1*c* allow the connection between a male part 20 and female part 50 of the connector regardless of relative rotational orientation.

SUMMARY OF INVENTION

According to the present invention there is provided an electrical connector comprising a male part and a female part for engagement therewith; the male part comprising a first terminal having a circular cross section and a second terminal; the female part comprising engaging means to engage said terminals; wherein the male and female parts each comprise a magnetic portion adapted to attract the parts together to form an electrical connection; magnetic misconnection means are provided to prevent the male and female parts from connecting in a non-concentric position; wherein at least some of the magnetic field or flux emitted from at least one of the magnetic portions extends beyond the magnetic misconnection means to attract the parts together to form an electrical connection.

Preferably, the first and second terminals are concentric.

Preferably, the second terminal is a pin terminal. Preferably, the second terminal has a circular cross section. Preferably, the first terminal is an annular terminal.

Preferably, the male or female part is attached to pendent means, more preferably, the female part is attached to the pendent means.

Preferably, the parts can engage with each other in any relative rotational orientation.

Preferably, the magnetic portions have a circular cross section, and are preferably in the form of an annular ring.

Preferably, at least one magnetic portion is provided in a recessed portion to prevent the magnets from connecting in a non-concentric position. Preferably, one of the male and female parts comprise walls extending away from its magnetic portion, the walls being adapted to prevent the male and female parts from connecting in a non-concentric position. Preferably, the male part comprises the walls.

It will be appreciated by the skilled person that a substantially concentric position is not to be regarded as a non-concentric position.

Preferably, the parts seek and locate with each other when brought into the vicinity of each other.

Preferably, the parts are adapted to be attracted together to form an electrical connection when they are between 1 cm and 30 cm apart.

More preferably, the parts are adapted to be attracted together to form an electrical connection when they are between 2 cm and 30 cm apart, although the parts may be adapted to be attracted together to form an electrical connection when they are between 5 cm and 30 cm apart. Indeed the parts may be adapted to be attracted together to form an electrical connection at greater distances.

Preferably, the terminals are male terminals.

Preferably, the first terminal is a neutral terminal and the second terminal is a live terminal and the engaging means of the female part may comprise respective female neutral and live terminals.

Preferably, the neutral and live terminals of the female part are enclosed. By 'enclosed' it is intended to mean that they are generally inaccessible except to the male terminals. This may be achieved by providing narrow apertures (preferably less than 3 mm wide) within the female part or providing a shutter means.

Optionally a male earth terminal may be provided. Preferably, the earth terminal has a circular cross section and is concentric with the first and second terminals. More preferably, the male earth terminal has a greater diameter than the other male terminals.

Preferably, the female portion has a circumferentially projecting portion. Preferably the said projecting portion has an aperture therein to receive the first male terminal. More preferably the projecting portion also has an annular groove therein to receive the second male terminal.

Preferably, the projecting portion is adapted to extend into or around the male part, preferably, the male earth terminal. More preferably, the diameter of the projecting portion allows it to pivot in the male part or the male earth terminal to a limited extent. Even more preferably, the projecting portion comprises a lip which is adapted to closely fit with the male part or male earth terminal. Preferably therefore, the rest of the projecting portion comprises a smaller outer diameter than an outer diameter of the lip.

Preferably, the projecting portion comprises a boss.

Preferably, the magnetic portion of the female part has a magnetic field which extends beyond the projecting portion to attract the parts together to form an electrical connection.

A corresponding female earth terminal may extend through the projecting portion of the female part.

Alternatively the first terminal is a pin terminal and the second terminal can be a leaf terminal. In alternative embodiments the pin terminal may be an earth terminal. Also, a resiliently mounted shutter may be provided on the female part.

Preferably, the male terminals are adapted to engage with the female terminals so that in use, the earth connection is the first to be made, then the neutral connection and lastly the live connection.

Preferably, the male terminals are adapted to disengage with the female terminals in the order: live first, neutral second, earth last.

Preferably, the female live and neutral terminals comprise a means to reduce the possibility of arcing during connection and disconnection; for example the female terminals may be coated with silver or silver pads.

Preferably, the male and/or female terminals are resilient in order such that they will maintain a connection with the corresponding female/male terminals. More preferably, the female terminals are resilient.

Preferably, at least one part comprises guide means to guide the parts together. The guide means may be in the form of a tapered face.

Preferably, the strength of the magnet is sufficient to attract the parts of the connector together. For example, where at least one part of the connector is connected to the pendent means and the other part of the connector is brought within 8 cm of the first part, the parts will preferably attract each other, and move towards each other and connect. Optionally, even stronger magnets may be used so that the parts can attract each other at distances of 12–15 cm.

The strength grade may be 30 although other grades may be used. The magnetic portions may be exposed on the outside of the parts or may be provided within a body of the parts.

Preferably, the magnetic portions are protected by at least one shield and may be protected by respective shields, such that when the male and female parts are connected together, the shield(s) is interposed between the magnetic portions. Thus, when the connector is engaged, the magnets do not come into direct physical contact.

Preferably, at least one of the magnetic portions is provided as a replaceable cartridge.

More preferably, an aperture is provided in at least one of the male and female parts through which the magnetic portions may be removed and replaced.

Alternatively, a removable cap may be provided on the male or female parts to allow the magnetic portions to be removed and replaced.

The connector may be used to connect electrical appliances to mains electrical supplies.

Alternatively one part of the connector may further comprise a standard bulb fitting at one end, such as a screw or bayonet, so that a bulb can be placed in that one part before the connection is made, thus allowing easier connection of the bulb to a difficult to reach or out of reach socket since the parts attract one another.

BRIEF DESCRIPTION OF THE DRAWINGS

Embodiments of the present invention will now be described by way of example only with reference to the accompanying drawings wherein—

FIG. 12*a* is a perspective view of the female part of FIG. 9*c;*

FIG. 12*b* is a partially cut away perspective view of the female part of FIG. 9*c;*

FIG. 12*c* is a second partially cut away view of the female part of FIG. 9*c;*

FIG. 12*d* is a partially cut away perspective view of the male part of FIG. 9*d;*

FIG. 12*e* is a perspective view of the male part of FIG. 9*d;*

FIG. 12*f* is a second partially cut away view of the male part of FIG. 9*d;*

DETAILED DESCRIPTION OF THE INVENTION

Figures 1A, 1B, 1C:
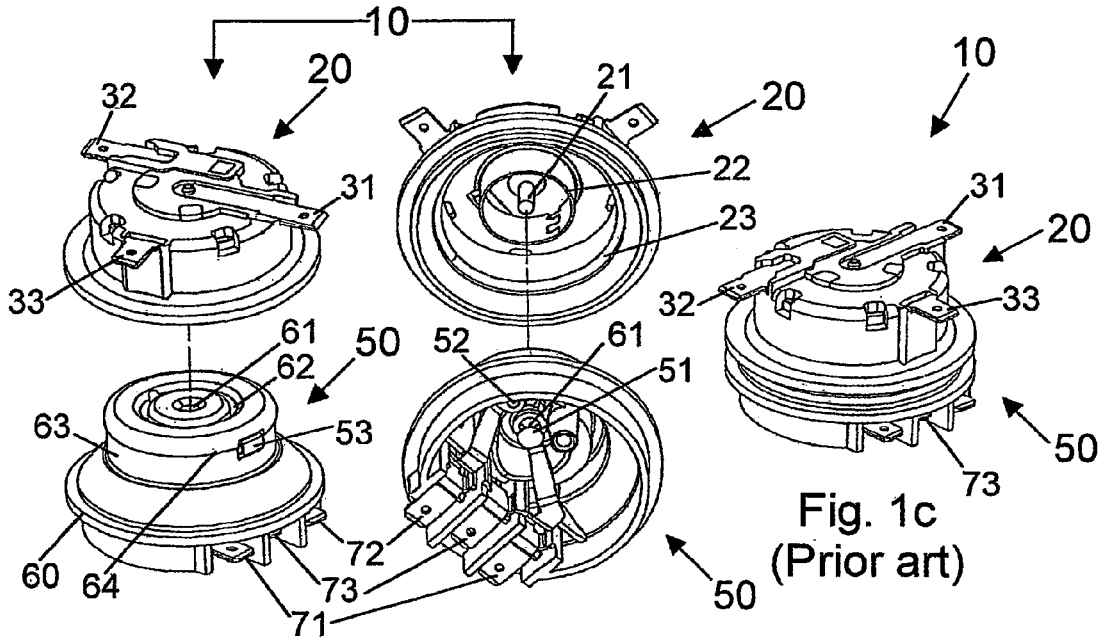
Fig. 1a (Prior art)
Fig. 1b (Prior art)
Fig. 1c (Prior art)
FIG. 1*a* is an upper perspective view of a known connector in its disconnected position.
FIG. 1*b* is a lower perspective view of the known connector of FIG. 1*a;*
FIG. 1*c* is an upper perspective view of the known connector of FIG. 1*a* but in its connected position.

A known connector 10 is shown in FIGS. 1*a*–1*c* and is disclosed in more detail in U.S. Pat. No. 5,971,810 the disclosure of which is incorporated herein by reference. The connector 10 comprises a male part 20 adapted to mate and form an electrical connection with a female part 50. The male part 20 comprises a live central pin terminal 21, and first neutral 22 and second earth 23 annular terminals. The female part comprises a boss 63 which projects from a body 60 of the female part 50, a central aperture 61 for receiving the pin terminal 21 and an annular recess 62 for receiving the annular terminal 22 of the male part 20. When connected, as shown in FIG. 1*c,* the second annular terminal 23 of the male part 20 locates around the boss 63 and live and neutral female terminals 51, 52 are located within the central aperture 61 and annular recess 62 respectively for electrical connection with the corresponding male terminals 21, 22. An earth terminal 53 is provided through a side wall 64 of the boss 63 to connect with the annular earth terminal 23 of the male part 20. All male and female terminals 21–23, 51–53 are attached to spade connectors 31–33, 71–73 respectively and in turn to electrical appliances or powers sources (not shown).

Figures 2A, 2B, 2C, 2D, 2E, 2F, 2G:
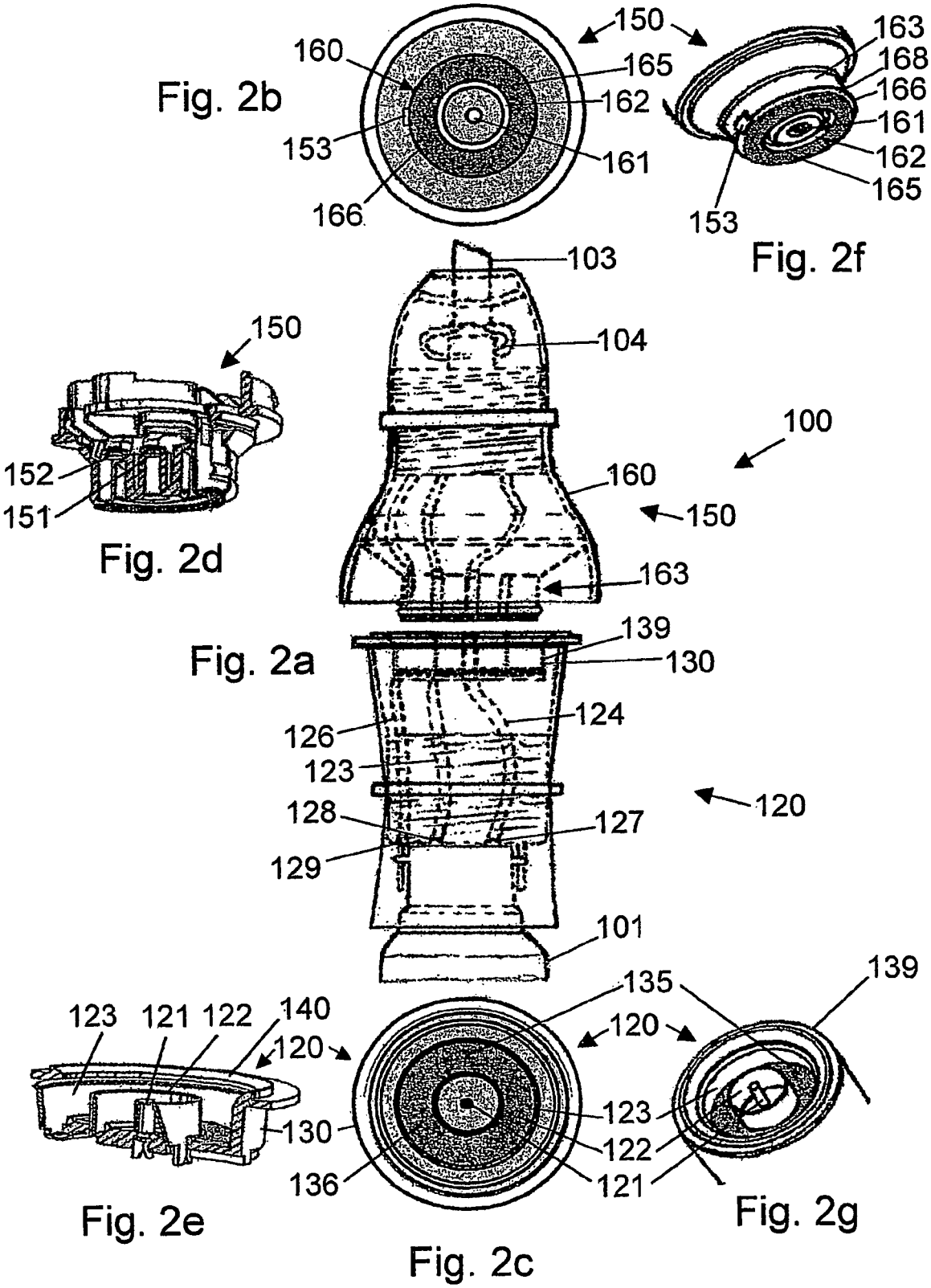
FIG. 2*a* is a side view of a first embodiment of a connector in accordance with the present invention, in a disconnected position with an attached light bulb.
FIG. 2*b* is a plan view of a female part of the connector of FIG. 2*a;*
FIG. 2*c* is a plan view of a male part of the connector of FIG. 2*a;*
FIG. 2*d* is a partially cut-away perspective view of the female part of FIG. 2*b;*
FIG. 2*e* is a partially cut-away perspective view of the male part of FIG. 2*c;*
FIG. 2*f* is a perspective view of the female part of FIG. 2*b;*
FIG. 2*g* is a perspective view of the male part of FIG. 2*c;*

A first embodiment of a connector 100 in accordance with the present invention in shown in FIG. 2*a*. The connector 100 comprises a male part 120 adapted to mate and form an electrical connection with a female part 150. A light bulb 101 is attached to the male part 120 at the opposite end of the connection with the female part 150 by any known means, in this embodiment, by a bayonet fitting 102, and can be removed and replaced when required by such known means. The male part 120, shown in plan view in FIG. 2*c,* comprises a body 130 having a central pin terminal 121, and first 122 and second annular terminals 123. The three terminals 121–123 are concentric.

In this embodiment the pin terminal 121 of the male part 120 is connected to a live terminal 127 of the standard connector 102 by wire 124 and the first and second annular terminals 122, 123 to neutral 128 and earth 129 terminals of the connector 102 respectively, also by wire 125, 126. It will be appreciated that some light fittings do not have earth connections and so their inclusion is optional. The male part 120 includes a tapered surface 140 to facilitate location with the female part 150.

The female part 150 is suspended from a ceiling (not shown) by a pendent or cable 103 and secured to the cable 103 by a cable clamp 104. The female part comprises a boss 163 which projects from a body 160, a central aperture 161 for receiving the pin terminal 121 and an annular recess 162 for receiving the first annular terminal 122 of the male part 120.

The boss 163 has a lip 168 which extends circumferentially outwards therefrom such that the diameter of the boss 163 with the lip 168 is greater than the diameter of the boss 163 without the lip 168. The lip 168 is sized to closely fit with the second annular terminal 123 and thus helps to align the parts 120, 150 together. The smaller diameter of the remaining portion of the boss 163 allows the parts 120, 150 to connect when they are at an angle to each other, and for the boss 163 to pivot within the annular earth terminal 123 into axial alignment with the male part 120.

Figure 3:
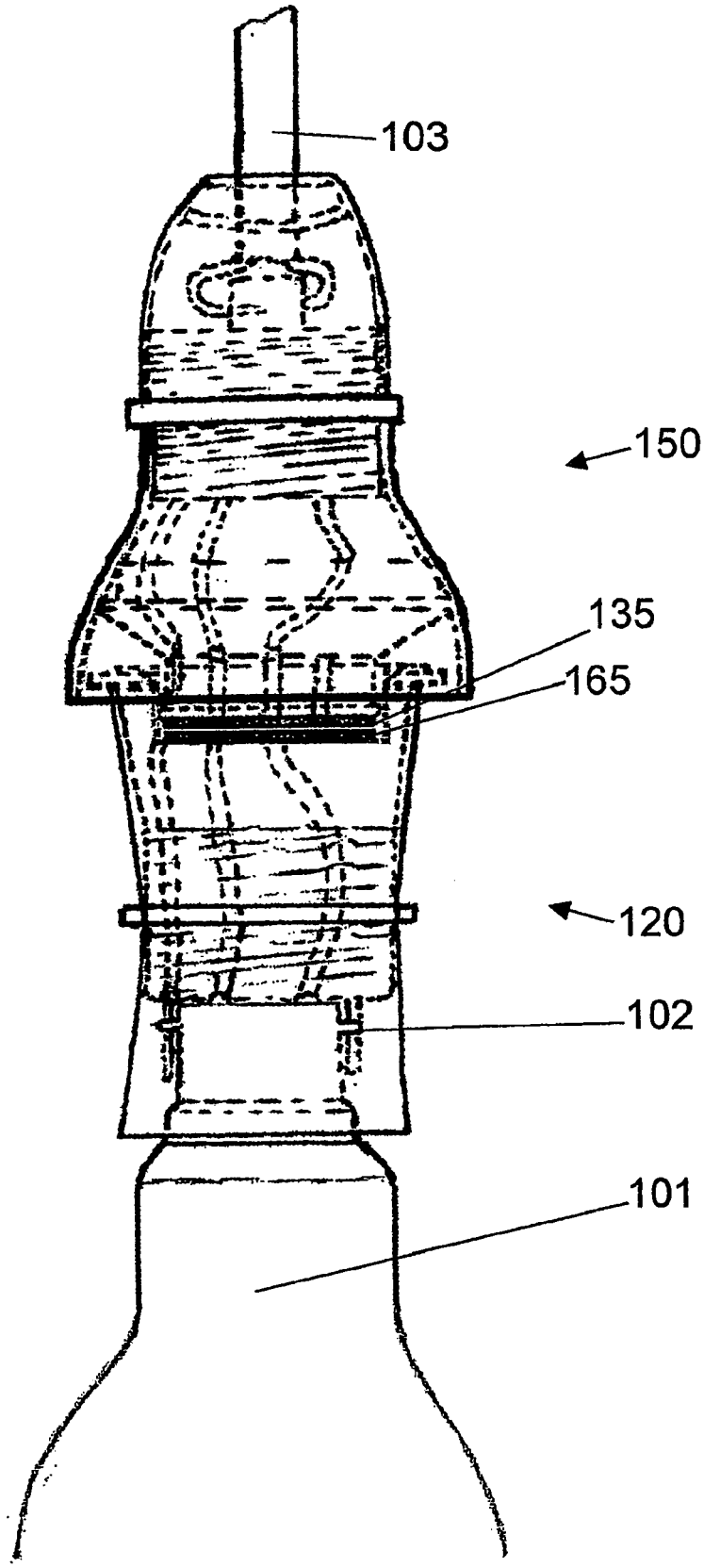
FIG. 3 is a side view of the connector of FIG. 2*a* but in its connected position.

When connected, as shown in FIG. 3, the second annular terminal 123 of the male part 120 locates around the boss 163. Female terminals 151, 152 are located within the central aperture 161 and annular recess 162 for electrical connection with the corresponding male annular terminals 121, 122. An earth terminal 153 is provided through a side wall 164 of the boss 163 to connect with the second (earth) annular terminal 123 of the male part 120.

The terminals in the female part 150 are spring loaded to maintain the connection between the respective male and female terminals and adapted so that a connection forms between the respective earth terminals 123, 153 then between the neutral terminals and then between the live terminals when the male 120 and female 150 parts are connected. Conversely, when the connection between the male 120 and female 150 parts is broken, the live terminals 121, 151 are adapted to disengage first, then the neutral terminals 122, 152 and lastly the earth terminals 123, 153. This ensures that sparking or arcing is minimised during connection and disconnection of the parts of the connector so that it is safe to use. Also, the male live and neutral connections are surrounded by the earth terminal 123 which reduces the possibility of electrocution when connected. The live 151 and neutral 152 terminals of the female part 150 are also safely enclosed within the female part 150 in line with British safety regulations. In order to further reduce the possibility of arcing during connection/disconnection of the parts 120, 150; the live 151 and neutral 152 terminal of the female part 150 are coated with silver or have silver pads.

A magnetic ring 135 is secured by spring clips (not shown) or any other suitable means to the male part 120 between the first annular terminal 122 and the second (earth) annular terminal 123. An oppositely attracting magnetic ring 165 is secured between the annular recess 162 and an edge 166 of the boss 163 of the female part 150, as shown in FIG. 2*f*. A suitable heat resistant glue may also be used to secure the magnetic rings 135, 165 to the parts 120, 150 although this is less preferred.

The magnetic ring 135 is provided in a recessed portion of the male part 120 such that the boss 163 of the female part 150 must extend into the male part 120 in order for the magnets to engage. This prevents the magnets joining in an offset position and is explained more thoroughly hereinafter.

In this embodiment the magnetic rings are annular rings and around 1.5 mm thick and have an outer diameter of 27 mm and a central aperture of diameter 15 mm although it will be appreciated that a variety of sizes may be used. A further embodiment has a diameter of 28 mm and a central aperture of 16 mm for the female part 150. The magnetic rings 135, 165 are powerful enough to attract the parts 120, 150 of the connector 100 at a distance of up to 8 cm. For stronger magnetic rings, the parts may attract each other at a distance of up to 12–20 cm. However there is a balance between proximity of location and ease of separation for different embodiments—extremely strong magnetic rings that locate one another over 30 cm apart would be increasingly difficult to separate when required. On the other hand, weak magnetic rings which are easier to separate would require the parts 120, 150 to be offered closer in order to seek and locate with each other and may not be powerful enough to maintain the weight of the male part 120 and attached bulb 101. therefore the direction of magnetism is through depth. For other embodiments, for example, those used in industrial applications, the strength grade may be higher.

The magnetic rings are available from Swift Levick Magnets Ltd, Barlborough UK; Goudsmit magnetics Limited of Surrey, United Kingdom or the Stanford Magnets Company of Aliso Viejo, Calif., USA. Alternatively, magnetic discs instead of magnetic rings may be utilised.

In alternative embodiments, magnetic particles can be mixed with nylon/plastic compound and injection moulded to the appropriate shape. For example, the boss 163 of the female connector could be formed from a mixture of NdFeB and/or SmCo particles and plastic which has been moulded to an appropriate shape. In such an embodiment, the magnetic particles are preferably distributed close to the edge of the boss such that it behaves similar to a separate boss and magnet attached together such as the boss 163 and magnet 165.

Pole pieces (not shown) may be provided within the male or female parts behind the magnets 135, 165 to direct the magnetic attraction more efficiently and thus aid the location of the parts 120, 150 together. Where pole pieces are used, the magnets 135, 165 may be weaker without reducing the forces attracting the opposite part. Pole pieces placed at the side of magnets increase the force of connection with the opposite part but decrease the distance at which the parts can attract each other. Therefore, in preferred embodiments, the pole pieces are not placed at the side of the magnets as greater attraction of the parts together is normally preferred to the strength of the eventual connection between the parts.

Optionally, a plastic sheath (not shown) may be provided over the pin terminal 121 leaving only its tip exposed for electrical connection with the female terminal 151. This reduces the possibility of arcing between the live and neutral terminals caused by metallic debris. To the same end, a plastic cone (not shown) may be provided around a portion of the pin terminal 121, and a tapered wall (not shown) may be provided on the inner face of the second annular terminal 122.

Thus, in use, the male part 120 of the connector 100 may be completely detached from the female part 150 and held in an operator's hand in the most convenient position. In this position, the light bulb 101 may be inserted into the socket 102 of the male part 120 so that the live, neutral and earth (if provided) terminals (not shown) of the bulb 101 connect with the respective terminals 127, 128 and 129 of the bayonet connector 102. The male part 120 with the attached light bulb 101 can then be raised towards the female part 150. This may be done by hand or, for example on a telescopic gripping pole (not shown). When the male 120 and female 150 parts are within the vicinity of each other the parts 120, 150 will automatically seek each other and form a connection with each other (as shown in FIG. 3) due to the magnetic attraction between the magnetic rings 135, 165 without the need for accurate alignment of the parts 120, 150 by the operator. The connection of the magnetic rings 135, 165 also results in the male terminals 121–123 and the female terminals 151–153 connecting with each other to form an electrical connection between the male and female parts 120, 150. Therefore the current can flow from a mains supply (not shown) through the cable 103, through the female part 150, through the connection formed between the female part 150 and the male part 120, through the male part 120, through the standard connection 102 and into the bulb 101. The magnetic rings 135, 165 therefore have two distinct functions, one, to locate the male 120 and female 150 parts together, and two, to hold the parts 120, 150 together.

Embodiments of the present invention benefit from being able to seek and locate the parts together at a relatively large distance, for example, 8 cm or up to 20 cm or more. This is in contrast to some previous magnetic connectors which must be aligned together by a user and where the magnetic field simply holds the different parts together. A variety of factors determine the distance at which the parts will seek together and automatically locate. These include the strength, shape and type of magnets used, the presence or absence of pole pieces, the weight of the suspended female part, and the length of the pendent upon which the female part is suspended. Preferred embodiments of the invention provide for such automatic connection when the parts 120, 150 are at least 2 cm apart.

Figure 17A:
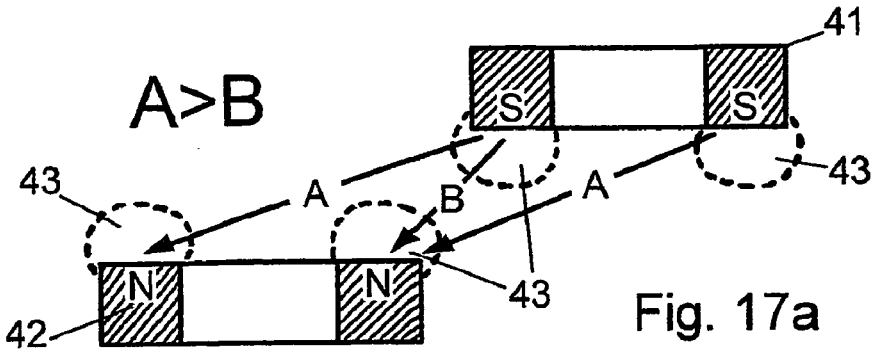
FIG. 17*a* is a sectional view of a pair of ring magnets approaching each other.
Figure 17B:
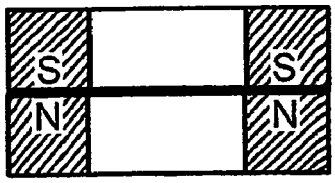
FIG. 17*b* is a sectional view of the ring magnets of FIG. 17*a* in a concentrically connected position.
Figure 18A:
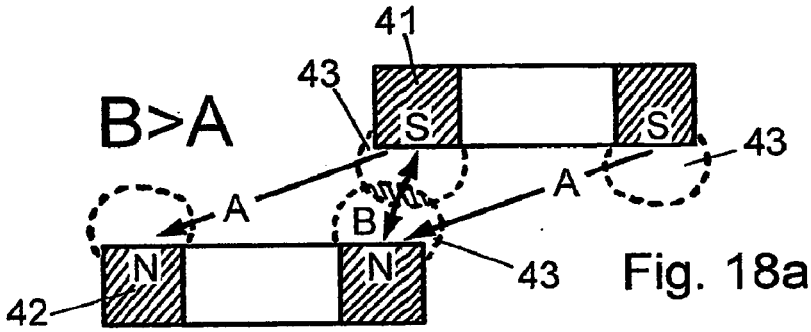
FIG. 18*a* is a sectional view of a pair of ring magnets also approaching each other but at a different angle than the ring magnets of FIG. 17*a;*
Figure 18B:
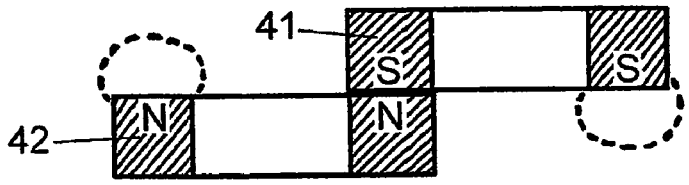
FIG. 18*b* is a sectional view of the ring magnets of FIG. 18*a* in an offset connected position.
Figure 19:
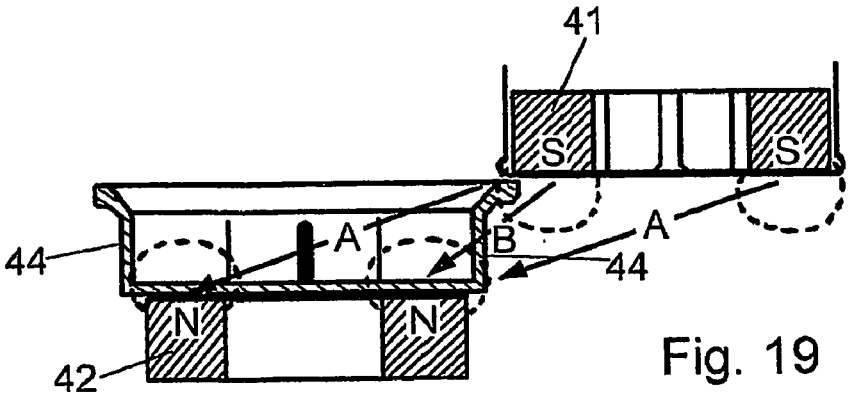
FIG. 19 is a further sectional view of a pair of ring magnets approaching each other.

The parts 120, 150 also locate automatically due to the recessed position of the magnet 135 of the male part 120 behind the wall 139 which prevents the parts from joining in an offset, non-concentric manner. FIGS. 17–19 show concentric and off-set connections which are possible by a pair of ring magnets 41, 42 approaching each other at an angle. Magnets 41, 42, shown in FIG. 17*a*, produce a magnetic field or flux attracting oppositely poled magnets or certain metals towards them. If the attractive force A which would result in a concentric connection is bigger than the attractive force B which would result in an offset connection, then the magnets 41, 42 will connect concentrically. Conversely, if the attractive force B is greater than the attractive force A then the magnets will connect in an offset position, as shown in FIGS. 18*a*, 18*b*. The attractive force B is only great enough to cause such offset connection when offset connection zones 43 of the magnets 41, 42 overlap in a non-concentric position. Lastly, as shown in FIG. 19*a*, if the magnet 42 has a wall 44, the magnet 41 is prevented from entering a position where the attractive force B is greater than that of A and so the magnets 41, 42 will always connect concentrically. The provision of the magnet 135 in a recessed position behind a wall 139 similarly prevents the parts 120, 150 connecting in an offset position because the wall 139 prevents the female part 150 from entering any area where the forces attracting the parts 120, 150 into an offset connection are greater than those which attract the parts 120, 150 into a concentric connection. Where such walls are provided, the magnets should be able to exert their magnetic fields beyond the walls in order to attract the two parts together.

The required height of the walls 139 to prevent off-set connection depends on the strength, type and size of the magnets. For example, if the male part 120 has a ring magnet of grade 30 Neo, 22 mm outside diameter, 8 mm inside diameter and is 10 mm thick, and a female part has a 2:17 grade SmCo female magnet of 23 mm outside diameter, 17 mm inside diameter and 5 mm thick, the separation between the magnets and the end of the walls should be at least 3 mm. Alternatively, for a male part 120 with a grade 30 Neo magnet, 20 mm outside diameter, 15 mm inside diameter and 5 mm thick interacting with the same female magnet, the separation should be at least around 5 mm. A further alternative is to have the male 120 and female 150 parts each with grade 30 Neo magnets 27 mm outer diameter, 15 mm inner diameter and 1.5 mm thickness, the minimum separation would be around 7 mm.

As well as ensuring a concentric connection, the length of the wall 139 should be sufficiently large to provide a good mechanical connection and resist accidental disconnection. Moreover, the length of the wall 139 also affects the influence of the magnetic flux emitted by the magnet 135—longer walls effectively increase the axial attraction relative to the transverse attraction. Shorter walls on the other hand effectively increase the transverse attraction relative to the axial attraction. A balance between axial and transverse attraction is required in order for the parts to self-seek and locate together without the need to be accurately aligned by the user. Therefore the separation is preferably larger than the minimum required to prevent off-set connection—around 1 cm for preferred embodiments.

Thus the operation of replacing a light bulb 101 is far more convenient than those of standard bayonet or screw thread connections because the more difficult act of locating the pins of the bayonet connection of the bulb 101 into the corresponding sockets or screwing a screw threaded bulb into the socket is done with hand held components in a position convenient to the operator rather than the out of reach or difficult to reach position where the light bulb 101 is attached and eventually hung.

Certain embodiments of the invention such as the connector 100 benefit from the advantage that the parts 120, 150 may connect together without being rotationally aligned making the connection even easier to form.

Certain embodiments of the invention such as the connector 100 benefit in that the parts 120, 150 of the connector 100 locating each other due to the interacting magnetic fields before securing the parts together. Therefore where it is difficult to align the male 120 and female 150 parts (for example the female part being in a difficult to reach position) then the operator only has to hold the male part 120 with attached light bulb 101 in the vicinity of the female part 150 for the parts to automatically seek, locate and form an electrical connection. This is in contrast to forming a bayonet connection which would require bringing the bulb in line with the socket, rotationally aligning the bulb with the socket, pressing the bulb and the socket together and twisting the bulb and socket with respect to each other before releasing; all in a position which is difficult to reach. Thus the use of steps, ladders or chairs in order to gain access to the out of reach socket/female part 150 is required less frequently for embodiments of the invention due to their ease of connection when compared with known sockets.

The nature of some ring magnets may make them susceptible to attract each other and join offset, in a non-concentric position. However certain embodiments of the invention, such as the connector 100, benefit in that the magnetic rings cannot misalign in such a manner because the magnet 165 on the female part 150 cannot access the magnet 135 due to the wall 139 unless it locates in a concentric position. Thus such an advantage further eases the location of the male 120 and female 150 parts for certain embodiments.

A second embodiment of a connector 200 in accordance with the invention is shown in FIGS. 4*a*–4*d*, 5*a*–5*c* and 20*a*–20*f*. The second embodiment is largely similar to the first embodiment 100 and like parts will not be described further. The major difference with the embodiment described so far is that a male part 220 part of the connector 200 is in turn connected to any electrical appliance (not shown) rather than a light bulb 101.

Thus embodiments of the invention, such as the connector 200, have the additional benefit in that they can provide a socket to a mains supply (not shown) for use with any type of electrical appliance, for example buffers, vacuum cleaners or industrial electrical appliances.

The connector 200 comprises a female part 250 suspended from a cable or pendent 203. The male part 220 being attached to the appliance via a cable 205 may be offered up to the female part 250 and the respective parts 220, 250 can seek and make a connection as described for the first embodiment.

Figures 20A, 20B, 20C, 20D, 20E, 20F:
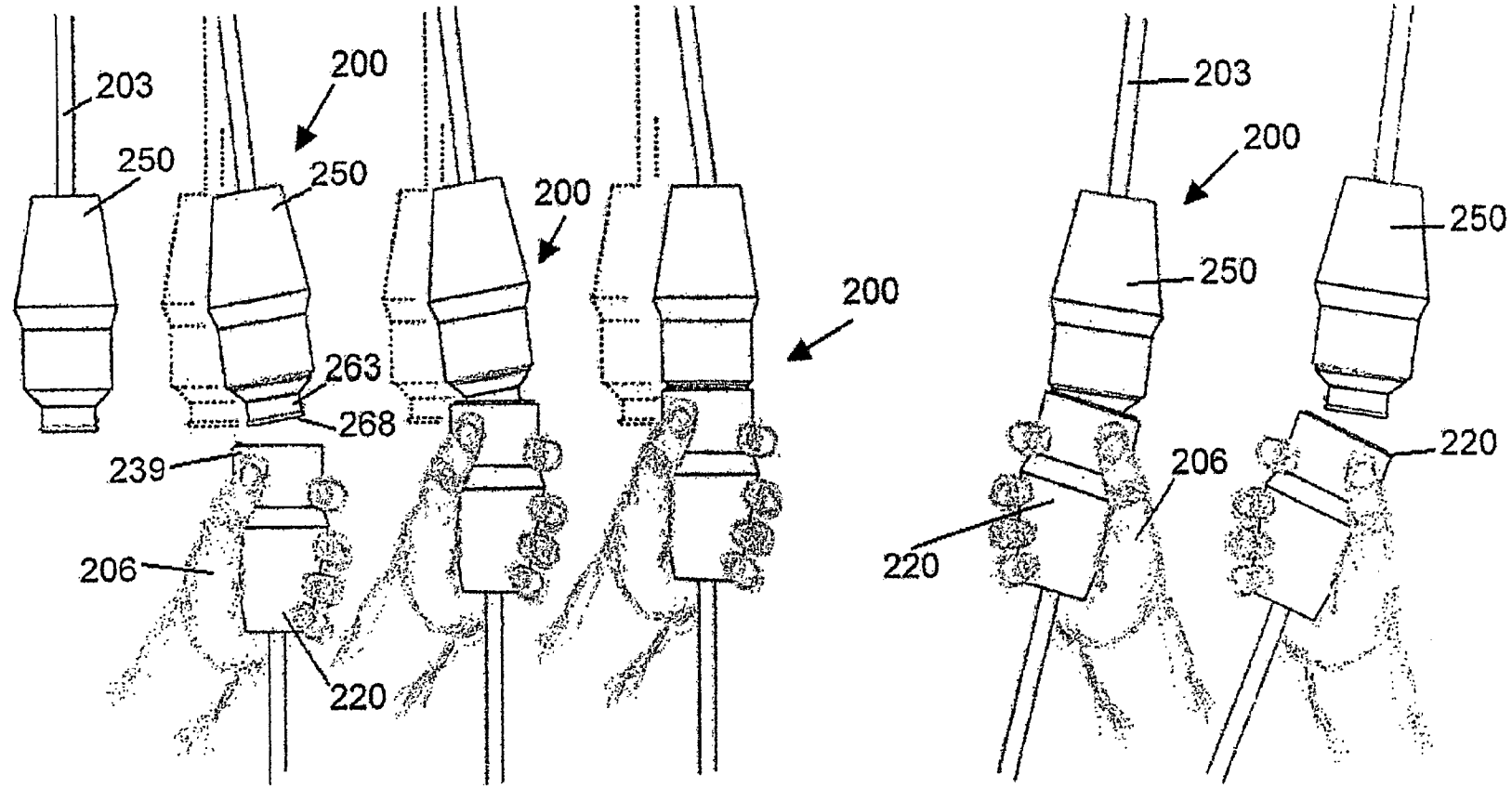
FIGS. 20*a*–20*d* are a series of front views showing the male and female parts of the FIG. 4*a* connector, connecting with each other.
FIGS. 20*e*–20*f* are a pair of front views showing the male and female parts of the FIG. 4*a* connector disconnecting from each other.
Figure 21:
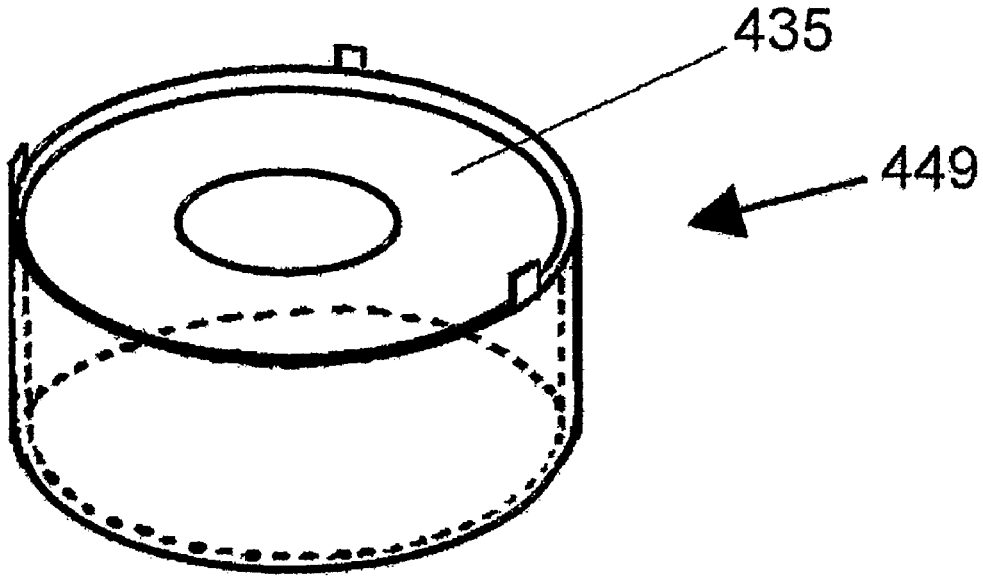
FIG. 21 is a perspective view of a cartridge and magnet of the fourth embodiment of the invention.
Figure 22:
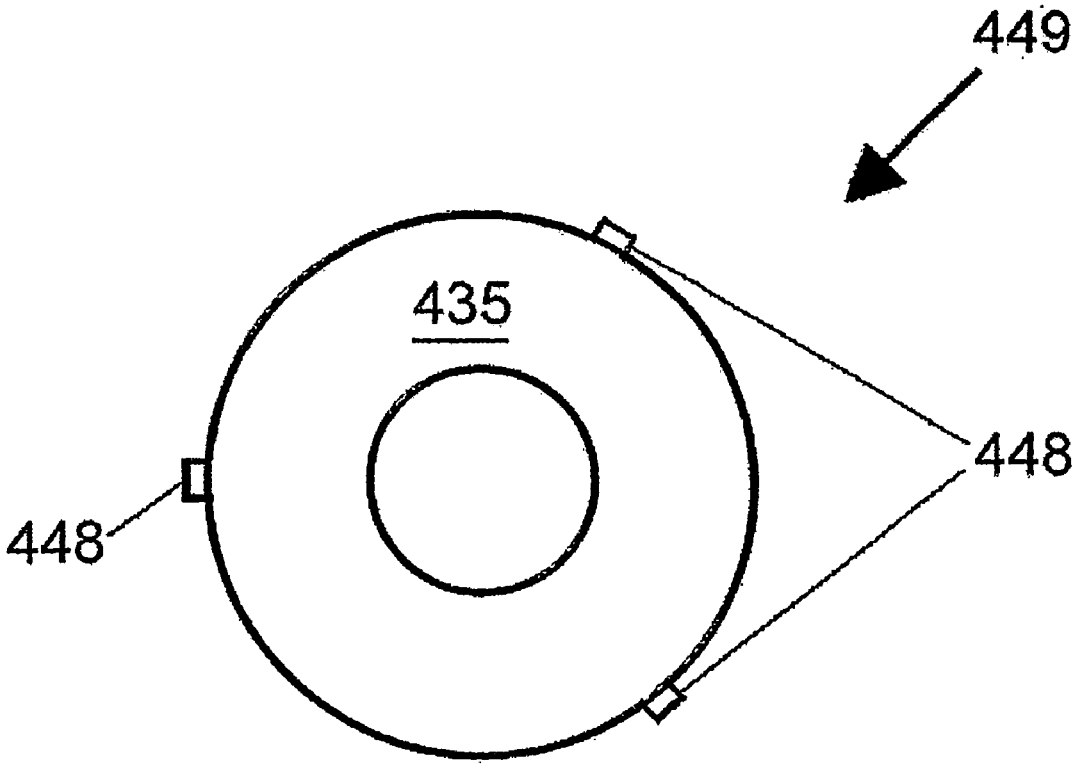
FIG. 22 is a top view of the cartridge and magnet of FIG. 21.

The male part 220 of the connector 200 also has a lip 268 on a boss 263 of the female part for close fitting with an second annular terminal 223 of the male part 220. The reduced diameter of the remaining part of the boss 263 compared to that around the lip 268 allows for the boss 263 to pivot to a limited extent within the second annular terminal 223 of the male part 220. FIGS. 20*a*–20*f* show the male 220 and female 250 parts of the connector being assembled and disassembled. The female part 250 is suspended from a cable 203 and the male part 220 is brought into its vicinity by a user 206. The interactive attraction between respective magnets 235, 365 (not shown in FIGS. 20*a*–20*f*) on the male 220 and female 250 parts respectively causes the female part 250 to swing towards the male part 220 and for the boss 263 to travel within the male part 220. A tapered surface (not shown) and walls 239 on the male part help to guide the boss 263 into the male part 220. As can be seen from the diagram, the parts 220, 250 connect at an angle to each other and would do so in most instances in practice unless the parts 220, 250 are offered up in axial alignment. Thus the ability to connect together at an angle is an important feature of preferred embodiments of the invention. The reduced diameter of the boss compared with that of the second annular terminal allows for such angled connection. The slightly increased diameter at the lip 268 helps to centre the boss 263 in the second annular terminal 223. Electrical contacts 221–223, 251–253 and magnets 235, 265 then connect as described in respect of the first embodiment and as shown in FIG. 20*d*. To disassemble the connector 200, a user prises apart the parts 220, 250 typically resulting in the male part 220 being released from the female part at an angle, since it is easier to first break the magnetic connection at one side rather than breaking the whole of the connection at once. The diameter of the boss 263 also provides for an angled disconnection, FIGS. 20*e*, 20*f*.

In common with other preferred embodiments, the electrical contacts are arranged to connect in the order: earth, neutral, live and to disconnect in the order: live, neutral, earth for safe working and to reduce the possibility of sparking or arcing. Even when connected at an angle, as shown in FIGS. 20*a*–20*f*, such an order of connection and disconnection of the respective terminals is maintained.

Optionally the male part 220 could be suspended from the cable 203 and the female part 250 brought into its vicinity but this is less preferred since the live contacts in the male part would be exposed which may be against safety regulations. Thus an advantage of certain embodiments of the present invention is that they are far safer to use than previous light sockets because the live contacts are enclosed within the female part and only accessible through narrow apertures (preferably, less than 3 mm wide).

Figures 4A, 4B, 4C, 4D:
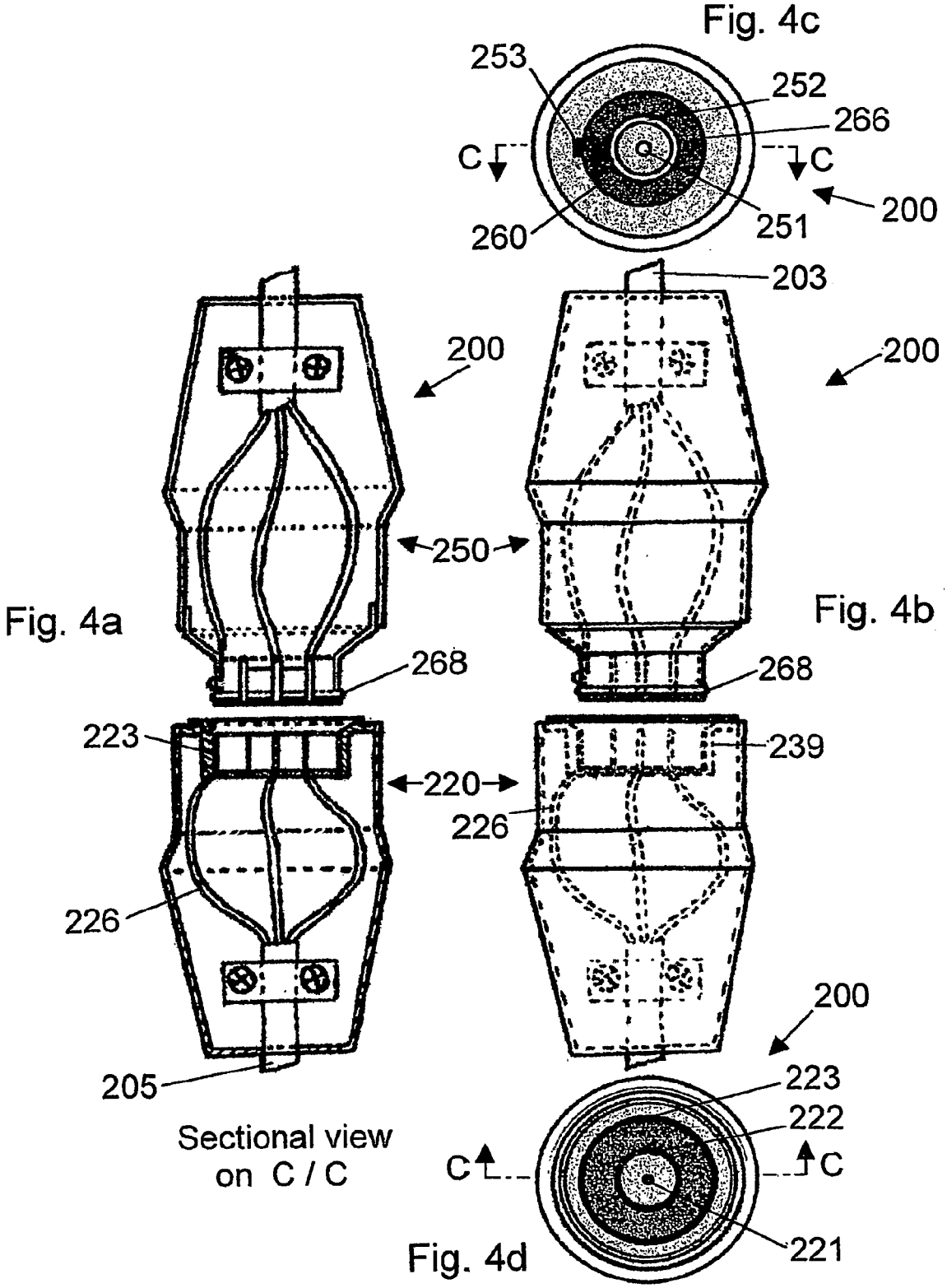
FIG. 4*a* is a side sectional view of a second embodiment of a connector in accordance with the present invention.
FIG. 4*b* is a side view of the connector of FIG. 4*a;*
FIG. 4*c* is a plan view of a female part of the is connector of FIG. 4*b;*
FIG. 4*d* is a plan view of a male part of the connector of FIG. 4*b;*
Figures 5A, 5B, 5C:
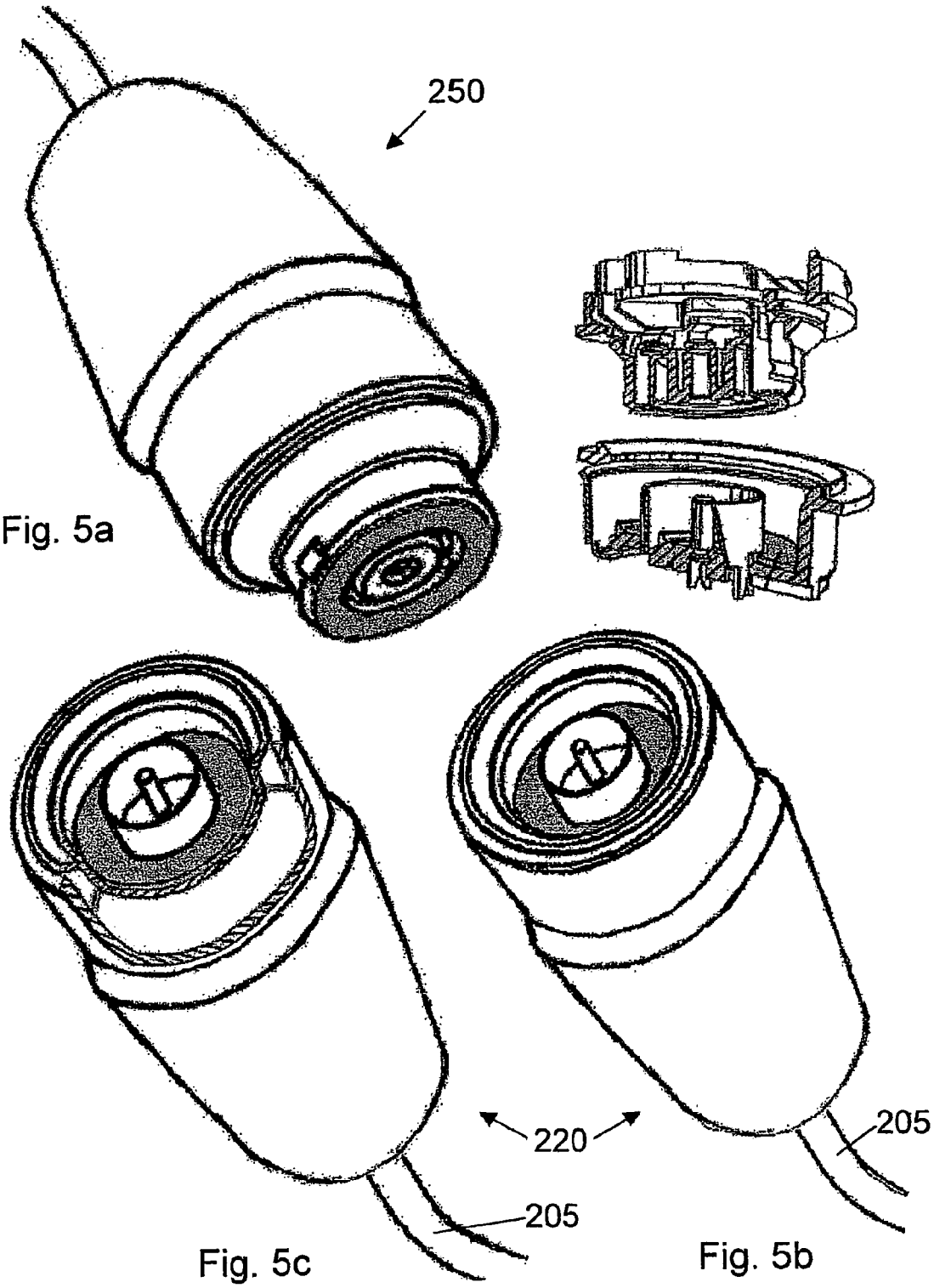
FIG. 5*a* is a perspective view of the female part of FIG. 4*c;*
FIG. 5*b* is a perspective view of the male part of FIG. 4*d;*
FIG. 5*c* is a second perspective view of the male part of FIG. 4*d* with a portion cut away.

Whereas an earth connection for the first embodiment of the invention was optional, an earth connection for the second embodiment is preferred. The annular earth terminal 223 of the male part is shown in FIGS. 4*a*, 4*b*, and is connected to an earth terminal (not shown) of the appliance via a wire 226.

Where an earth connection is provided for the second embodiment of the invention but not for the first embodiment of the invention, it is anticipated that the first embodiment of the invention could have a face 166 of the magnetic ring 165 of the female part 160 south poled whereas a face 266 of a magnetic ring 265 of the female part 260 of the second embodiment 200 could be North poled. Corresponding magnetic rings 136, 236 on the male parts 120, 220 would be oppositely poled so that a male part 220 belonging to the second embodiment 200 and having an earth connection would connect only to a female part 260 of the same embodiment which also has an earth connection but be repelled by the female part 160 belonging to the first embodiment of the invention which has no earth connection. Conversely a male part 120 belonging to the first embodiment 100 and having no earth connection would connect only to a female part 160 of the same embodiment which also has no earth connection but be repelled by the female part 260 belonging to the second embodiment of the invention which has an earth connection. This would add an extra safety feature to the connectors 100, 200 to ensure the respective male parts 120, 220 are connected to the correct female parts 160, 260 respectively.

Third and fourth embodiments of connectors 300, 400 in accordance with the invention are shown in FIGS. 6*a*–6*g*, FIG. 8 and FIGS. 9*a*–9*d* respectively. These embodiments 300, 400 correspond with the first 100 and second 200 embodiments of the invention and differ in the position and size of magnetic rings used.

Figures 6A, 6B, 6C, 6D, 6E, 6F, 6G:
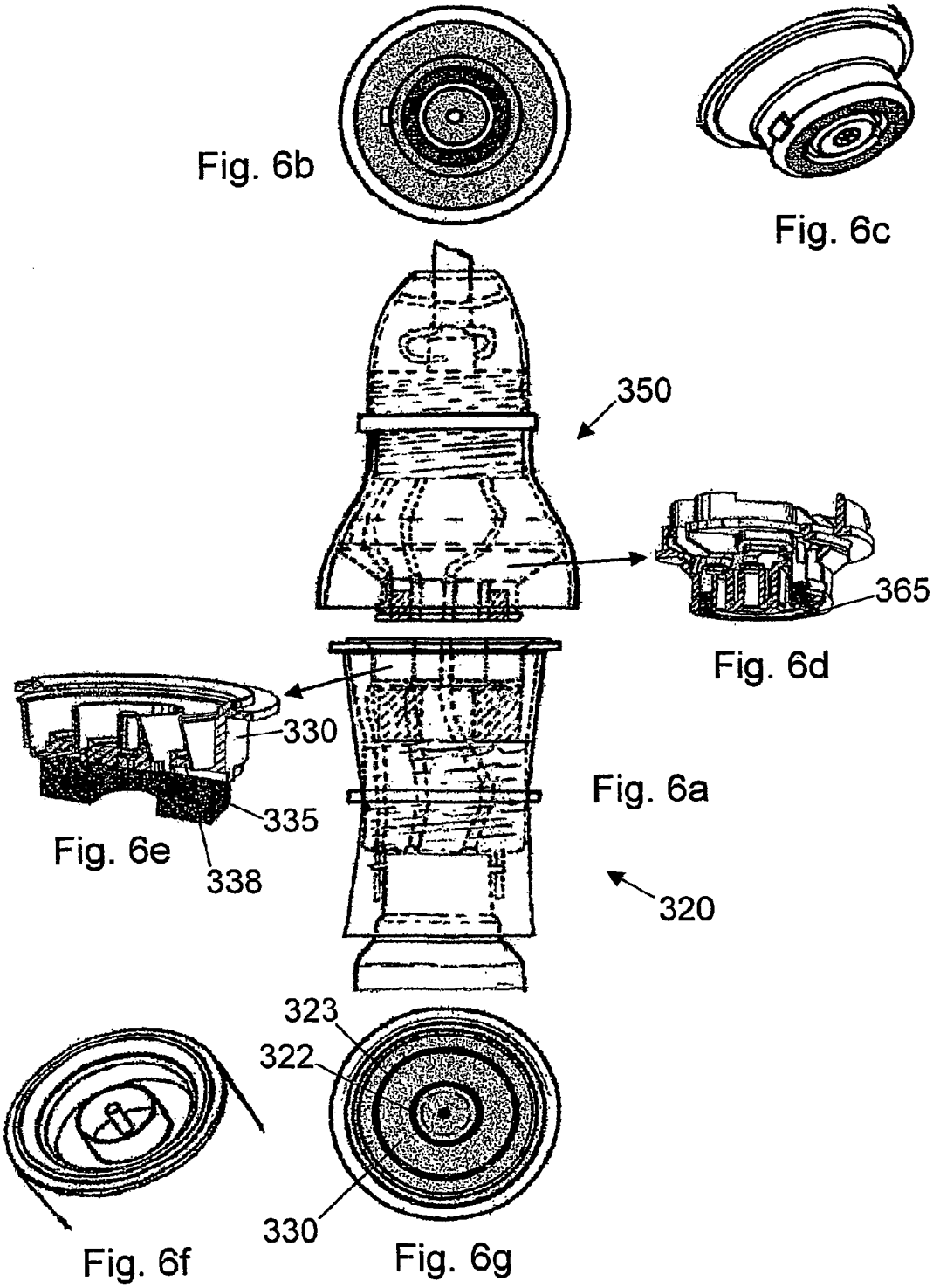
FIG. 6*a* is a side view of a third embodiment of a connector in accordance with the present invention, in its disconnected position with an attached light bulb.
FIG. 6*b* is a plan view of a female part of the connector of FIG. 6*a;*
FIG. 6*c* is a perspective view of the female part of FIG. 6*b;*
FIG. 6*d* is a partially cut away perspective view of the female part of FIG. 6*b;*
FIG. 6*e* is a partially cut away perspective view of a male part of the connector of FIG. 6*a;*
FIG. 6*f* is a perspective view of the male part of FIG. 6*e;*
FIG. 6*g* is a plan view of the male part of FIG. 6*e;*
Figure 7:
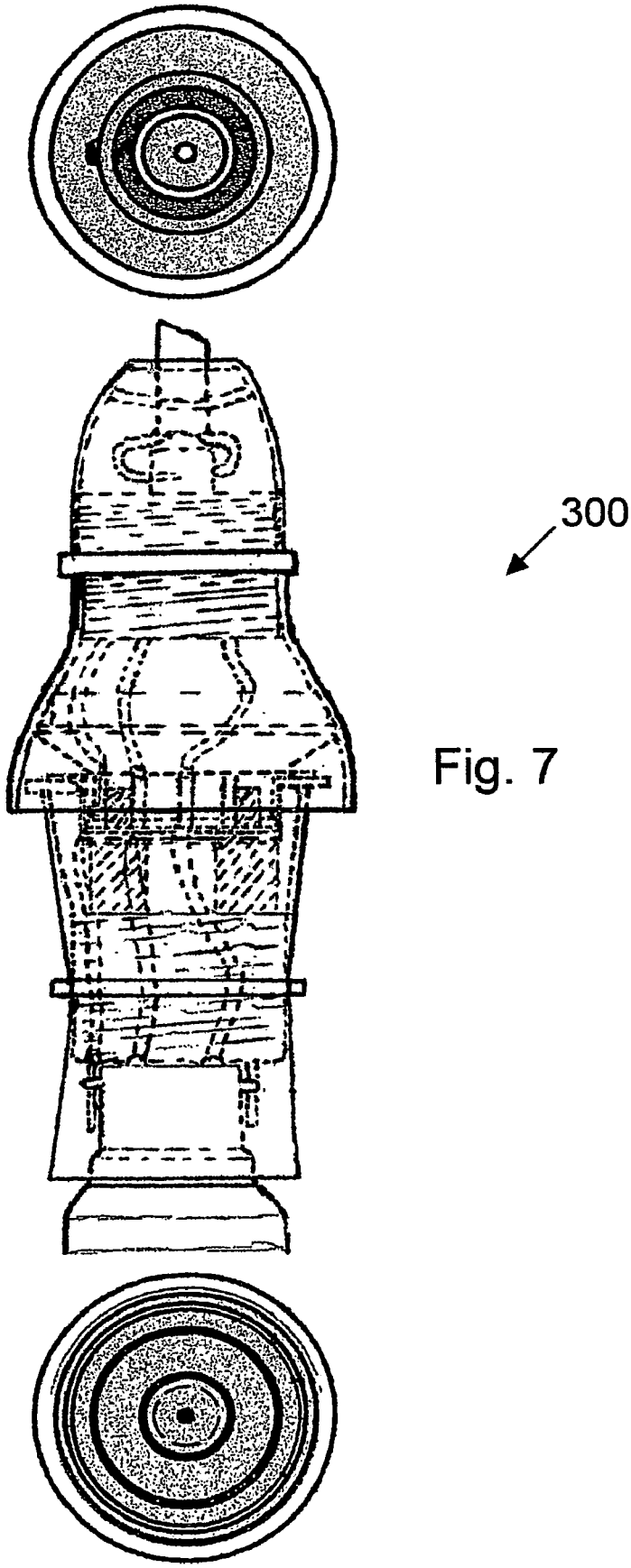
FIG. 7 is a side view of the connector of FIG. 6*a* but in its connected position.
Figure 8:
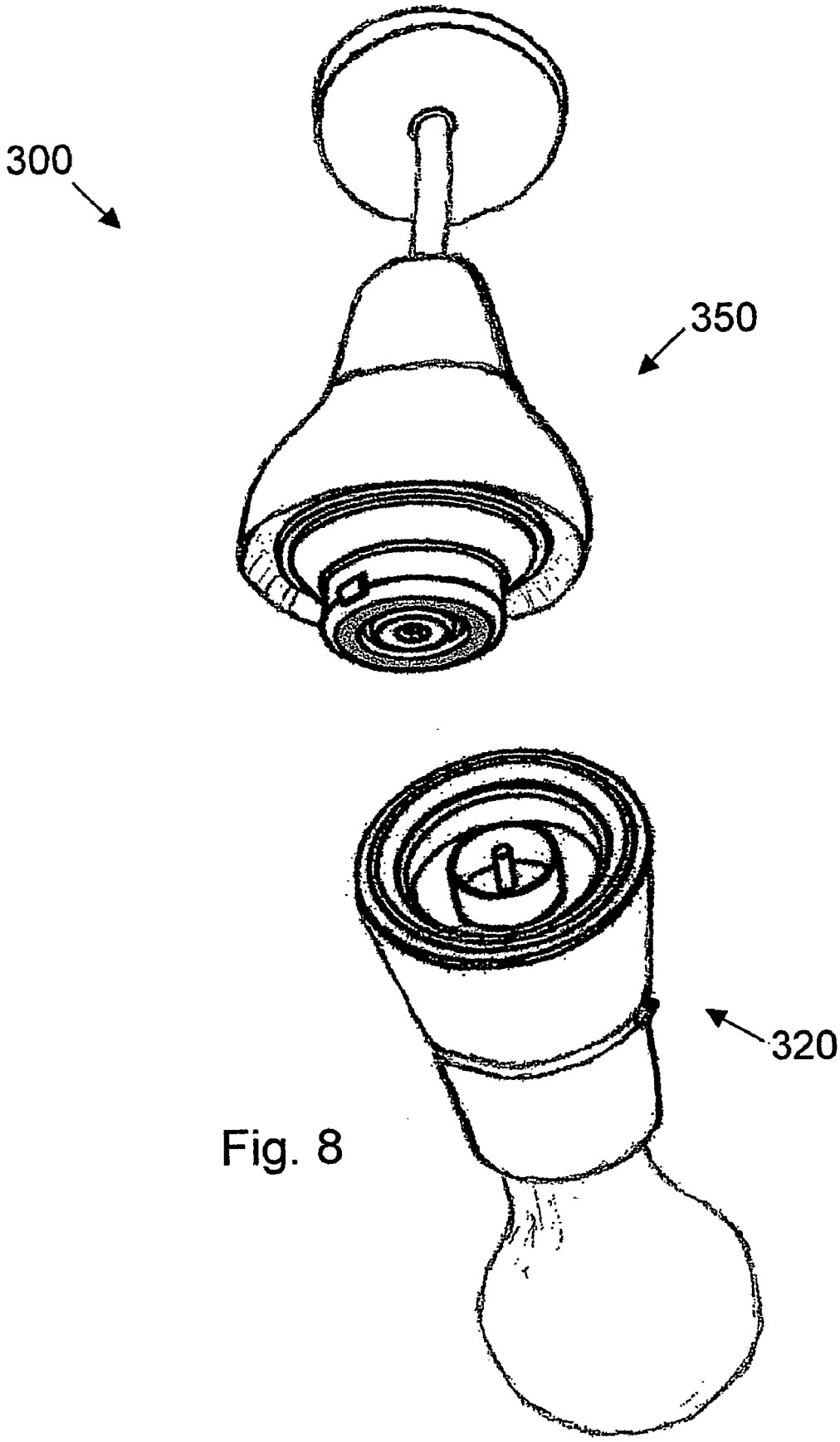
FIG. 8 is a perspective view of the connector of FIG. 6*a* with an attached light bulb.
Figures 9A, 9B, 9C, 9D:
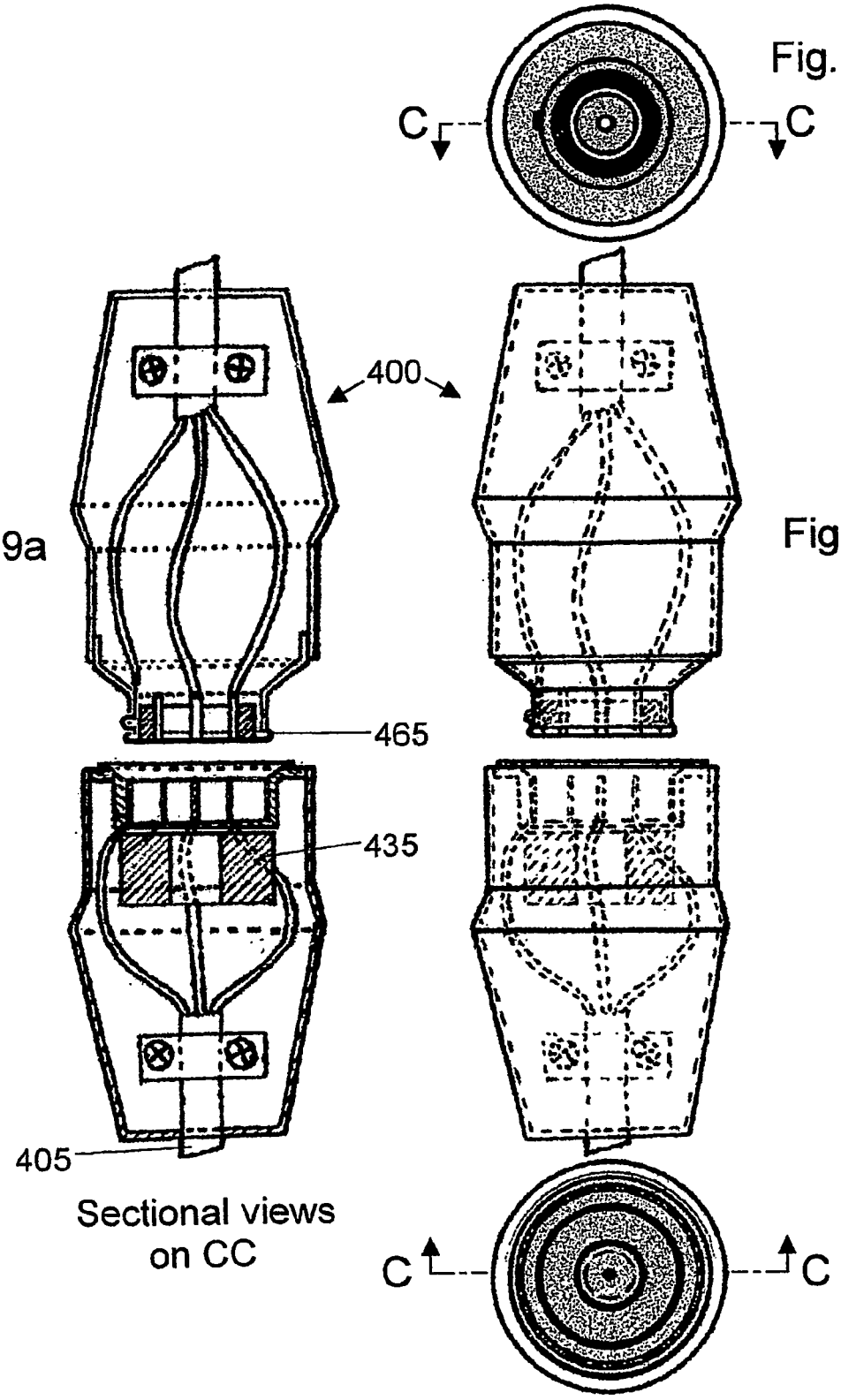
FIG. 9*a* is a side sectional view of a fourth embodiment of a connector in accordance with the present invention, in its disconnected position.
FIG. 9*b* is a side view of the connector of FIG. 9*a;*
FIG. 9*c* is a plan view of a female part of the connector of FIG. 9*b;*
FIG. 9*d* is a plan view of a male part of the connector of FIG. 9*b;*

The connector 300 comprises a magnetic ring 365 which is embedded in a female part 350 of the connector 300, as best shown in FIG. 6*d*. The magnetic ring 365 is around 5 mm in depth. A second magnetic ring 335 is mounted behind a body 330 of the male part 320 in order to protect the second magnetic ring 335 from connecting impact damage, accidental damage or rusting by the body 330 of the male part 320. A non-magnetic shield 338 is provided between the magnet 335 and the end of the male part 320. The magnetic ring 335 is around 10 mm in depth. However, the depth of the magnetic ring 335 may be increased without increasing the size of annular rings 322, 323 to allow a boss 363 to enter therebetween. The magnetic ring 365 of the female part 350 may additionally or alternatively be embedded within the female part 350 behind a similar shield (not shown) for the same reasons. In such embodiments the magnetic rings 365, 335 being thicker than the corresponding magnetic rings of the first and second embodiments, can provide a stronger magnetic field and increase the distance between which the parts 320, 350 of the connector 300 can locate each other. Thus when the parts 320, 350 are in their connected position the magnets will self-align, as for previous embodiments, but will not connect face to face due to the shield 338. FIG. 7 shows the connector 300 in its connected position.

Figures 10, 11:
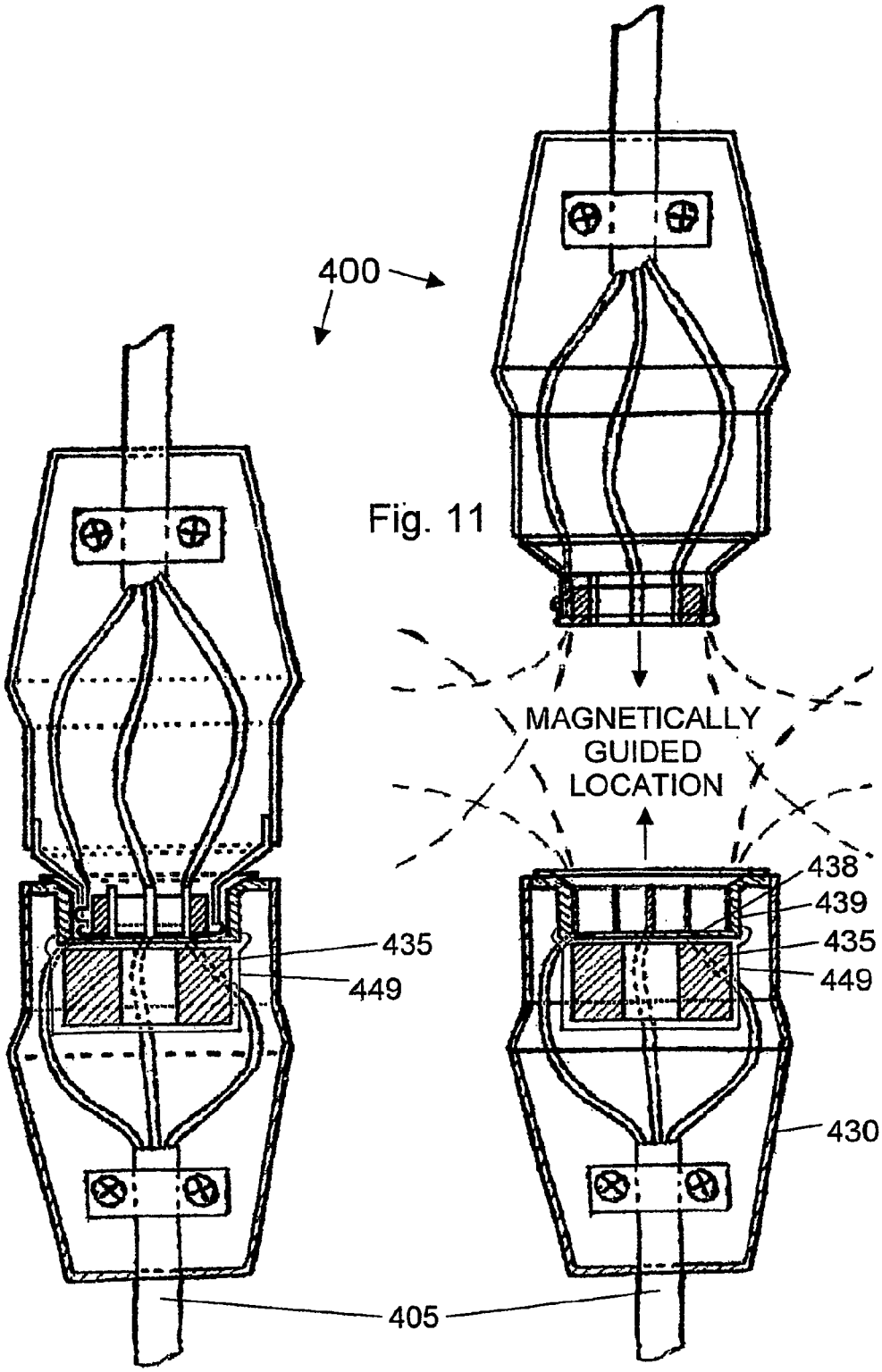
FIG. 10 is a side sectional view of the connector of FIG. 9*a* but in its connected position.
FIG. 11 is a side sectional view of the connector of FIG. 9*a* showing magnetic attraction between the male and female parts.
Figure 13:
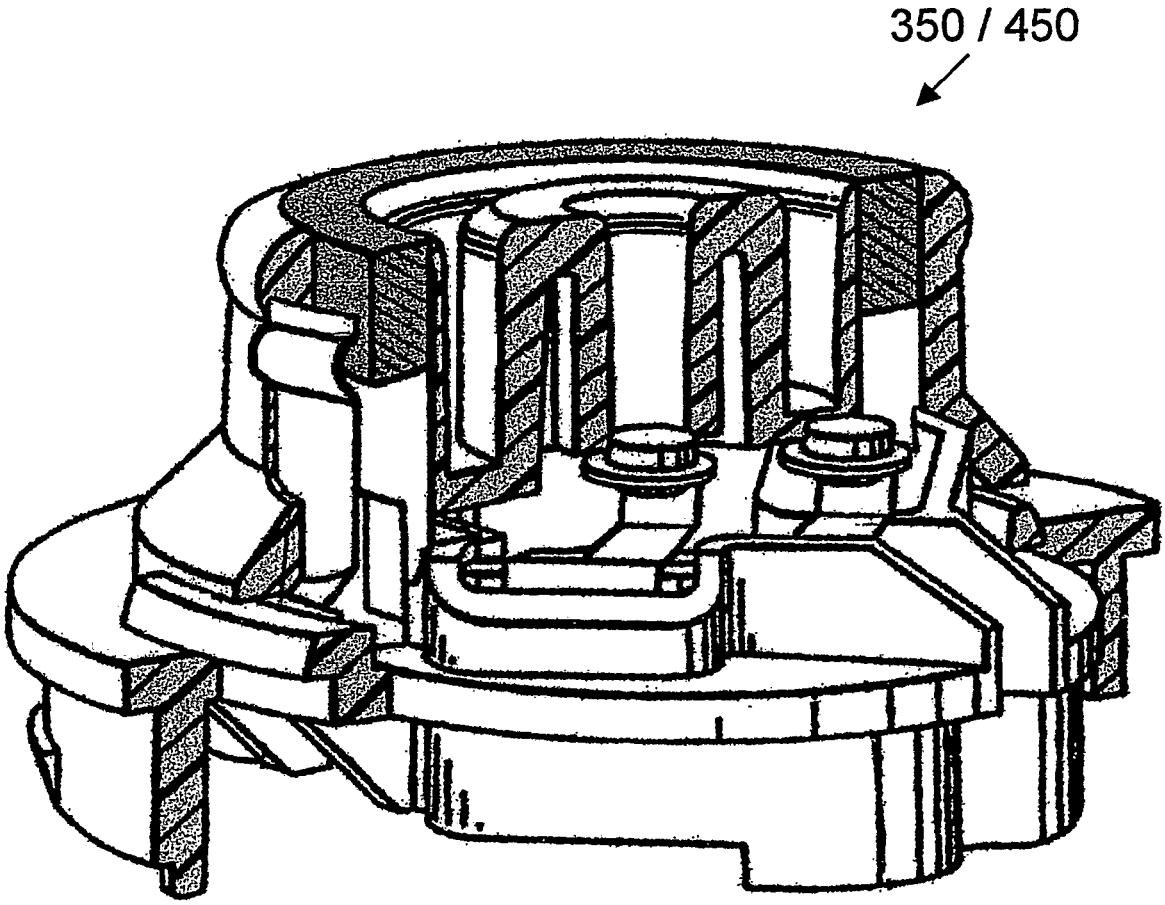
FIG. 13 is an enlarged view of the female part of the connector of FIG. 12*c;*

The connector 400 also has the thicker magnetic rings 435, 465. The typical magnetic fields created by the annular magnets 435, 465 is shown in FIG. 11 and the connector 400 in its connected position is shown in FIG. 10 and further views are shown in FIGS. 12*a*-12 & 13. p A significant advantage of certain embodiments of the invention, such as the third and fourth embodiments, is that any brittle magnets are protected by shields making them less liable to chipping, breakage or other connection impact damage. Thus, the male 335 and female 365 magnets will never come into direct contact even when the parts 320, 350 have connected because they will remain spaced apart by the shield(s) 338. The shield(s) 338 may be made from, for example, any suitable plastic and are also preferably designed to absorb the high impact shock when the two parts engage with each other. Although providing shields 338 will reduce the magnetic attraction and strength of the connection between the magnets 335, 365 it has been found that this does not prevent the male and female parts, such as the parts 320, 350, seeking and locating with each other. Moreover, less metallic dust or debris will be attracted into the connector 300, 400 if the magnets are spaced away from the outer periphery of the parts 320, 350.

The height of the shield 338 should also be taken into account when determining the necessary height of walls. Thus, as described above, where a separation of at least 3 mm is required to prevent the magnets joining in an off-set position, the walls need only be, for example 2 mm, if the shield is 1 mm thick.

The magnet 435 is provided in a cartridge 449 (shown in FIGS. 10, 11, 21 and 22) which can be slotted in and out of the male part 420 of the connector 400. The cartridge 449 has clips 448 to secure it into the male part 420. Alternatively a male body 430 of the male part 420 can comprise a releasable cap (not shown) which itself comprises walls 439 and a shield 438 which is removable from the rest of the male body 430 to provide access to the magnet 435. This can allow for easy cleaning of the connector 400 since any metallic dust or debris which has collected on the shield(s) 438 will be released therefrom when the magnet 435 is removed. The magnet 435 can also be conveniently replaced with new magnets or magnets of a more suitable strength for particular applications. Similar cartridges (not shown) may be used to slot into the female part 450 although cartridges are particularly useful for the male part 420 as it is more likely to gather debris because it is normally a hand-held component whereas the female part 450 which is normally suspended from a pendent.

Figure 14:
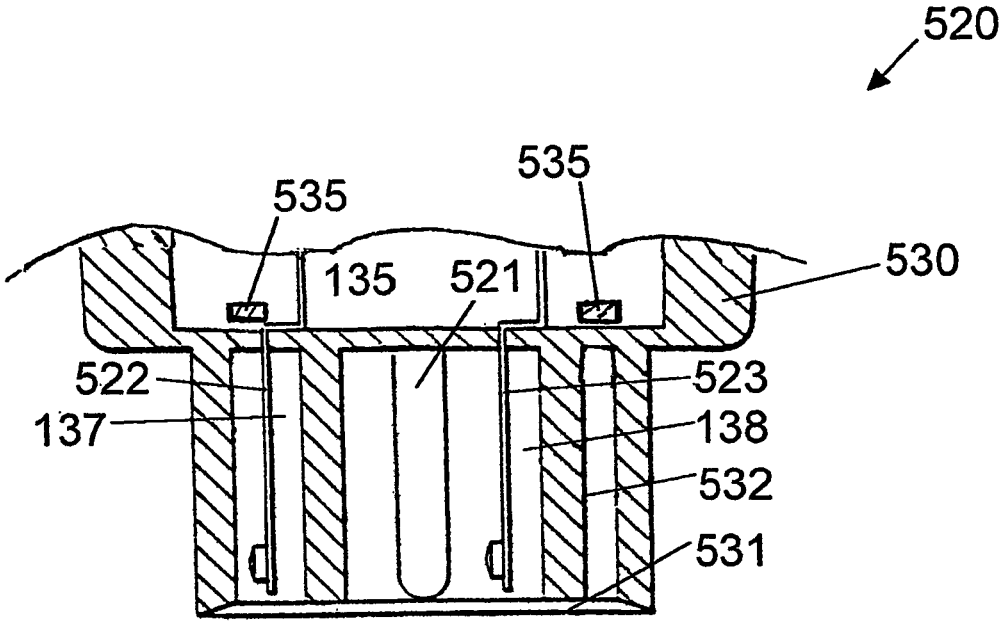
FIG. 14 is a sectional view of a male part of a fifth embodiment of a connector in accordance with the present invention.
Figure 15:
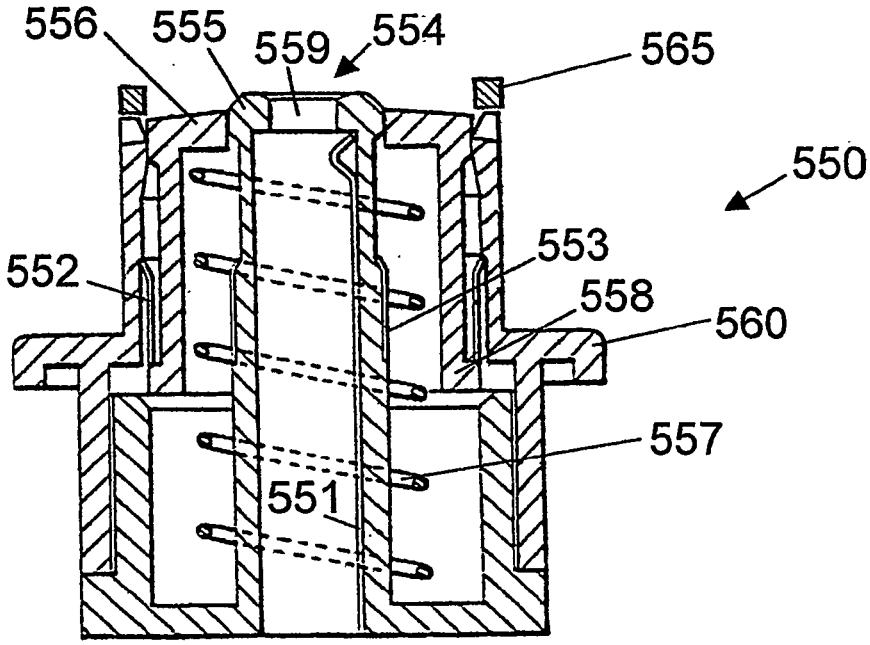
FIG. 15 is a sectional view of a female part of the embodiment of FIG. 14.
Figure 16:
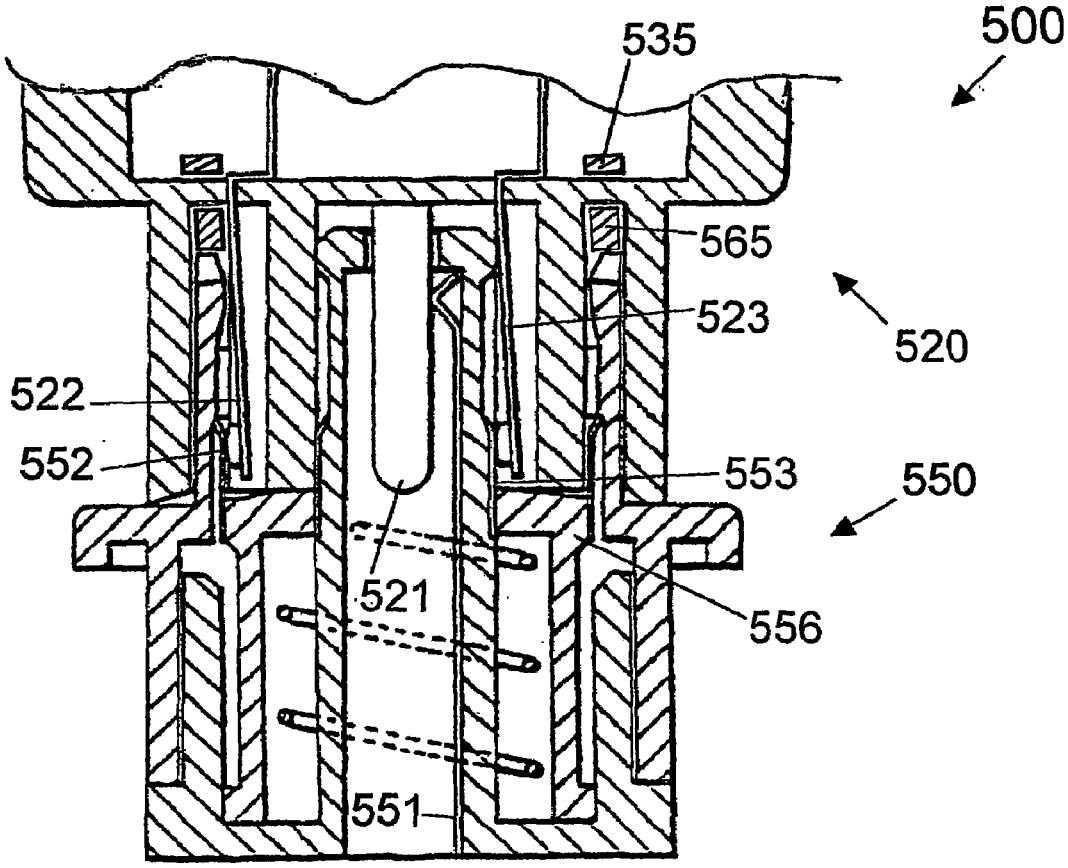
FIG. 16 is a sectional view of the male and female parts of the connector of FIGS. 14 and 15 in a connected position.

A fifth embodiment 500 in accordance with the present invention is shown in FIGS. 14–16 and comprises a male part 520 and female part 550. A comparable connector is disclosed in EP0922426, the disclosure of which is incorporated herein by reference. The fifth embodiment is similar to the first and third embodiments of the invention in that the male part 520 comprises a portion (not shown) which is adapted to receive a light bulb and the female part is connected to, and suspended from a pendent (not shown).

The male part 520, shown in FIG. 14, comprises a ring magnet 535, a central pin earth terminal 521, spring neutral and live terminals 522, 523, and a cylindrical abutment 532; all housed within an outer casing 530.

The female part 550, shown in FIG. 15, comprises a spring contact finger 551 and annular terminals 552, 553 for respective connection with the terminals 521–523 of the male part 520. The female part also includes an oppositely poled ring magnet 565, a shutter 556, a spring 557 and a hollow post 555 with an aperture 554; all housed within an outer casing 560.

In use, the female part 550 is suspended by the cable. The male part 520 is brought into proximity with the suspended female part 550 and their oppositely poled magnets 535, 565 attract each other. This causes a circular shaped bottom face 531 of the abutment 532 to abut with the shutter 556 of the female part 550. The shutter 556 is depressed into the outer casing 560 of the female part 550 against the action of the spring 557 by the attraction of the respective magnetic rings 535, 565. Concurrently, the earth pin terminal 521 moves through the aperture 554 of the post 555 and connects with the spring finger 551. As the male part 520 continues to move into the female part 550, the spring terminals 522, 523 of the male part 520 connect with the annular terminals 552, 553 of the female part to complete the connection. The connector 500 is shown in its connected state in FIG. 16.

The provision of a shutter 556 within the female part 550 encloses the terminals 521–523 within the female part and thus reduces the likelihood of electrical shock to a user. Should the shutter 556 be depressed at a single point, then it will move laterally, pivoting around the point 559 causing a side wall 558 of the shutter 556 to abut with an inner face of the casing 560 and so resist further depression into the female part 550. This ensures the female terminals 551–553 are not exposed unless the shutter 556 is depressed at at least two generally opposite points on its surface.

It is clear from the foregoing description that the earth, neutral and live terminals in any embodiment may be provided as pins, springs or annular rings.

Suspending cables from the ceiling for mains power supply may be safer than having the cables left along the floor. Connectors in accordance with the present invention would provide a straightforward way in which to connect and disconnect appliances from such cables. Moreover, should one trip on a trailing cable the connection would break apart without damage to the connection and would allow the cable to give under action of the person tripping, reducing the possibility of injury to that person.

Certain embodiments of the invention are useful in areas where electrical power has to be made conveniently and safely available but out of reach for Health and Safety reasons. Certain connectors in accordance with the invention may be used in areas which need to be cleared quickly such as hotels, schools or shopping precincts and quickly connected or disconnected as required or as dictated by floor movements.

Embodiments of the invention are also suitable to be used not only for mains voltages but also for higher, industrial level voltages, for example of around 1000 Volts.

Thus it will be appreciated that for certain embodiments of the invention such as the connector 300 or 400, the magnetic rings need not come into direct physical connection with each other as they may be protected, for example, by providing them within a body of the respective parts in order to protect them from accidental damage and/or from rusting. They nevertheless aid the parts' connection with each other due to the attraction between their respective magnetic fields.

Improvements and modifications may be made without departing from the scope of the invention. For example, the male (or female) part may be wired to any other type of standard connector such as a 2 or 3 pin plug socket to allow for onward connection to appliances having cables with such 2 or 3 pin plugs.

The invention claimed is:

1. An electrical connector comprising a male part and a female part for engagement therewith; the male part comprising a first terminal having a circular cross section and a second terminal; the female part comprising engaging means to engage said terminals; wherein the male and female parts each comprise a magnetic portion adapted to magnetically attract the parts together to form an electrical connection; magnetic misconnection means are provided that prevent the male and female parts from magnetic attachment in a non-concentric position; wherein at least some of a magnetic field emitted from at least one of the magnetic portions extends beyond the magnetic misconnection means to attract the parts together to form an electrical connection.

2. A connector as claimed in claim 1, wherein the magnetic misconnection means comprises a wall extending away from the magnetic portion of one of the male and female parts, the wall being adapted to prevent the male and female parts from connecting in a non-concentric position.

3. A connector as claimed in claim 2, wherein at least one of the male and female parts is attached to pendent means.

4. A connector as claimed in claim 3, wherein one of the male and female parts is attached to pendent means and the other of the male and female parts comprises the wall.

5. A connector as claimed in claim 1, wherein the female part has a projecting portion which is adapted to be received within the male part.

6. A connector as claimed in claim 5, wherein the magnetic portion of the female part has a magnetic field which extends beyond the projecting portion to attract the parts together to form an electrical connection.

7. A connector as claimed claim 5, wherein the projecting portion is adapted to have a degree of freedom to pivot within the male part.

8. A connector as claimed in claim 5, wherein the projecting portion has at least one aperture to receive at least one of the male terminals.

9. A connector as claimed in claim 1, wherein the first terminal is a neutral terminal and the second terminal is a live terminal and the engaging means of the female part comprise respective neutral and live terminals.

10. A connector as claimed claim 9, wherein the neutral and live terminals of the female part are enclosed.

11. A connector as claimed in claim 9, wherein the neutral and live terminals of at least one of the male and female parts are resilient.

12. A connector as claimed in claim 9, wherein the male and female parts each include an earth terminal which are adapted to engage with each other.

13. A connector as claimed in claim 12, wherein the male earth terminal is concentric with at least one of the first and second terminals of the male part.

14. A connector as claimed in claim 12, wherein the terminals are adapted to engage in the order: earth, then neutral, then live when the male and female parts are being connected and are adapted to disengage in the order: live, then neutral, then earth when said parts are being disconnected.

15. A connector as, claimed in claim 1, wherein the magnetic portions have a circular cross section.

16. A connector as claimed in claim 15, wherein the magnetic portions are in the form of an annular ring.

17. A connector as claimed in claim 1, wherein one of the male and female parts is also adapted for use with any type of electrical appliance.

18. A connector as claimed in claim 1, wherein the male and female parts are adapted to be attracted together to form an electrical connection when they are between 1 cm and 30 cm apart.

19. A connector as claimed in claim 1, wherein the male and female parts are adapted to be attracted together to form an electrical connection when they are between 2 cm and 30 cm apart.

20. A connector as claimed in claim 1, wherein the male and female parts are adapted to be attracted together to form an electrical connection when they are at between 5 cm and 30 cm apart.

21. A connector as claimed in claim 1, wherein at least one of the parts comprises a tapered face adapted to guide the parts together.

22. A connector as claimed in claim 1, wherein the first and second terminals are concentric.

23. A connector as claimed in claim 1, wherein the male and female parts are adapted to engage with each other in any relative rotational orientation.

* * * * *